US010156344B2

(12) United States Patent
Dhillon et al.

(10) Patent No.: US 10,156,344 B2
(45) Date of Patent: Dec. 18, 2018

(54) LIGHTING FIXTURE WITH DROP LENS

(71) Applicant: Focal Point, LLC, Chicago, IL (US)

(72) Inventors: Randeep S. Dhillon, Vernon Hills, IL (US); Tejas M. Raut, Chicago, IL (US)

(73) Assignee: Focal Point, LLC, Chicago, IL (US)

( * ) Notice: Subject to any disclaimer, the term of this patent is extended or adjusted under 35 U.S.C. 154(b) by 0 days.

(21) Appl. No.: 15/681,571

(22) Filed: Aug. 21, 2017

(65) Prior Publication Data

US 2018/0051861 A1 Feb. 22, 2018

Related U.S. Application Data

(60) Provisional application No. 62/377,097, filed on Aug. 19, 2016.

(51) Int. Cl.

| | |
|---|---|
| ***F21V 5/00*** | (2018.01) |
| ***F21V 5/04*** | (2006.01) |
| ***F21V 5/02*** | (2006.01) |
| ***F21V 17/16*** | (2006.01) |
| *F21S 8/02* | (2006.01) |
| *F21V 7/00* | (2006.01) |
| *F21V 13/04* | (2006.01) |
| *F21V 15/01* | (2006.01) |
| *F21Y 113/00* | (2016.01) |

(Continued)

(52) U.S. Cl.

CPC ..... *F21V 5/007* (2013.01); *F21V 5/008* (2013.01); *F21V 5/02* (2013.01); *F21V 5/048* (2013.01); *F21V 17/16* (2013.01); *F21S 8/026* (2013.01); *F21V 7/005* (2013.01); *F21V 13/04* (2013.01); *F21V 15/01* (2013.01); *F21Y 2103/10* (2016.08); *F21Y 2113/00* (2013.01); *F21Y 2115/10* (2016.08)

(58) Field of Classification Search

CPC ..... F21V 5/007; F21V 5/048; F21V 5/008; F21V 5/02; F21V 13/04; F21V 3/00; F21V 21/005; F21S 8/04; F21S 8/02; F21S 8/06; F21S 4/003; F21S 2/00; F21Y 2103/00

See application file for complete search history.

(56) References Cited

U.S. PATENT DOCUMENTS

2007/0076427 A1* 4/2007 Reo ..... F21V 5/008 362/555
2009/0103315 A1* 4/2009 Ladstatter ..... F21S 8/02 362/355

(Continued)

*Primary Examiner* — Y M. Lee
(74) *Attorney, Agent, or Firm* — Banner & Witcoff, Ltd.

(57) ABSTRACT

The invention includes a drop lens that is generally rectangular-shaped and fits over a housing of a light fixture. The drop lens may include two side portions that attaches to and/or engages with the side panels of the housing. The drop lens includes an inner lens that extends between each of the side portions of the drop lens. The inner lens may be preferably constructed of a flexible plastic material so that it can be flexed and bent to engage the side portions of the drop lens. The inner lens disperses the light from the light source, thereby creating a uniform and consistent luminance on the bottom, sides, and ends of the drop lens. Additionally, the invention may include an upper lens that extends between and is slidably engaged with each of the side panels of the housing. The upper lens slides within the housing to hide the light source through a gap or seam between a first drop lens section and the second drop lens section.

9 Claims, 10 Drawing Sheets

(51) Int. Cl.
*F21Y 103/10* (2016.01)
*F21Y 115/10* (2016.01)

(56) References Cited

U.S. PATENT DOCUMENTS

| | | | | |
|---|---|---|---|---|
| 2013/0033859 | A1* | 2/2013 | Yaphe | F21V 5/007 362/223 |
| 2017/0122510 | A1* | 5/2017 | Tanifuji | F21S 8/04 |
| 2017/0370538 | A1* | 12/2017 | Zhang | F21S 4/28 |

* cited by examiner

LIGHTING FIXTURE WITH DROP LENS

CROSS REFERENCE TO RELATED APPLICATION

This application claims priority to U.S. Provisional Application No. 62/377,097 filed on Aug. 19, 2016. The above referenced application is incorporated by reference in its entirety.

FIELD OF THE INVENTION

The present invention relates to housing and lenses used for light fixtures, more specifically a drop lens design for LED recessed light fixtures.

BACKGROUND

Light fixtures and recessed light fixtures are known, and are typically used when it is desirable to minimize the projection of the light fixture below the ceiling surface. Recessed light fixtures tend to be more aesthetically appealing and provide a cleaner look when installed. Light fixtures that substantially extend below the ceiling surface may also be utilized. Recessed light fixtures tend to be used in commercial settings such as offices and the like.

Generally, light fixtures such as these may include plastic lens attached to the housing. Light fixtures utilizing a plastic lens may have various problems and issues associated with their design. First, the plastic lens and lighting configuration with LEDs and other light sources may cause shadowing on the lens cap. Additionally, as the side walls of the lens increase in height, the holding force of the lens is reduced. What is needed is a lens and light fixture that eliminates the shadowing and provides a greater holding force for the lens.

The invention includes a drop lens that is generally rectangular-shaped and fits over a housing of a light fixture. The drop lens may include a bottom portion, two side portions that attach to and/or engage with the side panels of the housing of the light fixture and two opposing end panels. The drop lens includes an inner lens that extends between each of the side portions of the drop lens and the side panels of the housing of the light fixture. The inner lens may slide or fit into the side portions of the drop lens or the side panels of the housing. The inner lens is preferably constructed of a flexible plastic material so that it can be flexed and bent to engage the side portions of the drop lens. The inner lens may provide two different purposes and advantages: 1) the inner lens disperses the light from the light source, thereby creating a uniform and consistent luminance on the drop lens; and 2) the inner lens creates and forms a structure with the drop lens and greatly enhances the holding forces of the drop lens.

BRIEF SUMMARY

The following presents a simplified summary of the invention in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

Aspects of this disclosure may relate to a light fixture that includes a housing, a light source attached to the housing, and a drop lens. The housing may include a top panel, a pair of opposing side panels, and a pair of opposing end panels. The drop lens may include a bottom portion, two side portions, and a pair of opposing end panels and may be generally rectangular in shape. The drop lens may attach to the housing with an attaching portion that engages with the side panels of the housing. The drop lens may further include an inner lens that extends between each of the side portions of the drop lens. The inner lens may disperse light from the light source, thereby creating a uniform and consistent luminance on the bottom portion, two side portions, and two opposing end portions of the drop lens.

Additionally, other aspects of the disclosure may relate to a light fixture assembly or a series of light fixtures connected together that includes one or more light fixtures that each include a housing, a light source attached the housing, and a drop lens, that may include multiple drop lens sections. When the fixtures are joined together there may be another inner lens that covers a potential gap or seam between the drop lens sections. The housing may include a top panel, a pair of opposing side panels, and a pair of opposing end panels. The drop lens sections may include a bottom portion and two side portions. The drop lens sections may be attached to the side panels of the housing. The drop lens sections may further include a first inner lens that extends between each of the side portions of the drop lens sections. The first inner lens may disperse light from the light source, thereby creating a uniform and consistent luminance on the bottom portion, two side portions, and two opposing end portions of the drop lens sections. There may be an additional second inner lens that is rectangular in shape and extends between and slidably engages with each of the side panels of the connected housings. The second inner lens may slide within the connected housings or the drop lens sections to hide the view of the light source through the potential gap or seam between the drop lens sections.

BRIEF DESCRIPTION OF THE DRAWINGS

A more complete understanding of the present invention and the advantages thereof may be acquired by referring to the following description in consideration of the accompanying drawings, in which like reference numbers indicate like features. The present invention is illustrated by way of example and not limited in the accompanying figures in which like reference numerals indicate similar elements and in which.

The reader is advised that the attached drawings are not necessarily drawn to scale.

DETAILED DESCRIPTION OF THE INVENTION

In the following description of various example embodiments of the invention, reference is made to the accompanying drawings, which form a part hereof, and in which are shown by way of illustration various example structures, devices, systems, and environments in which aspects of the invention may be practiced. It is to be understood that other specific arrangements of parts, structures, example devices, systems, and environments may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

Figure 1:
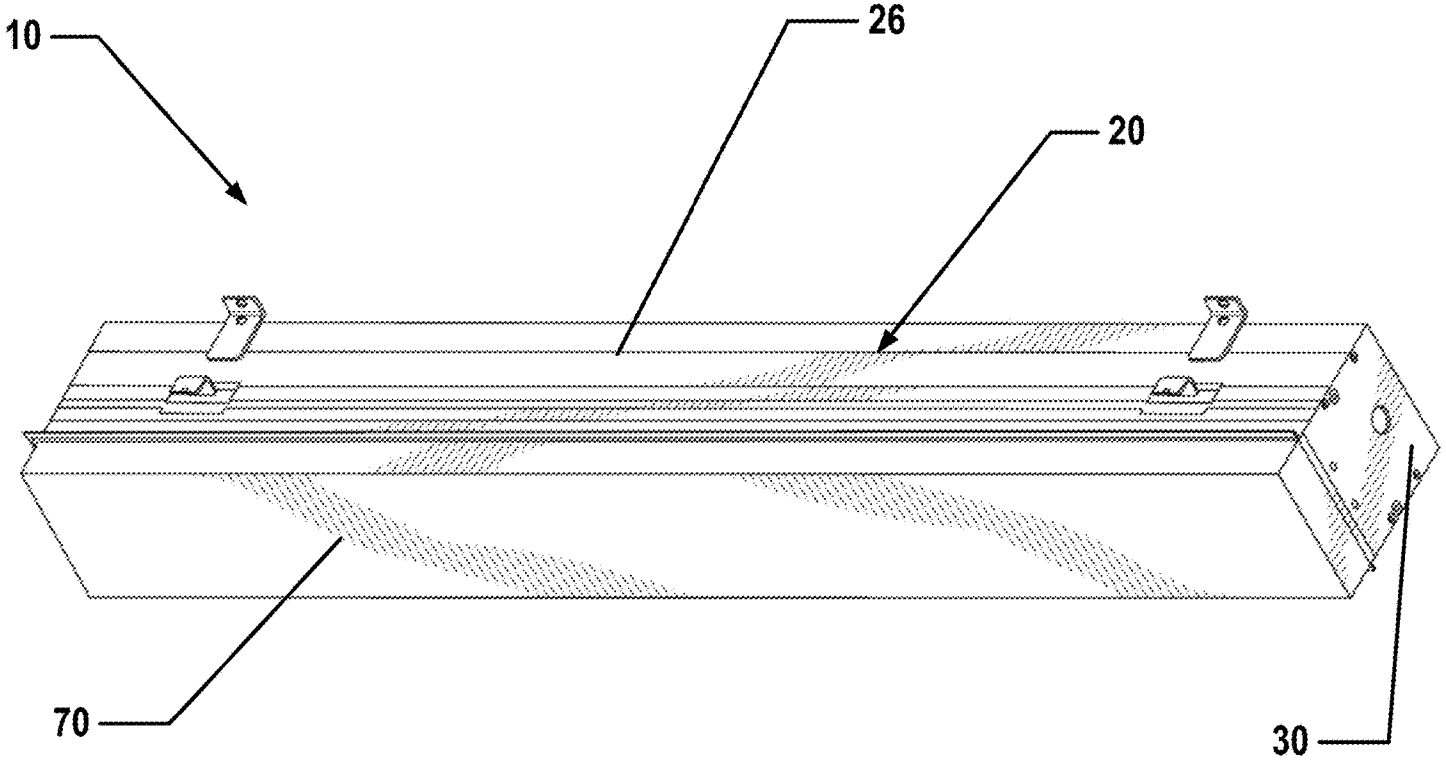
FIG. 1 is an illustration of a bottom-angled perspective view of an embodiment of a housing and a drop lens of a light fixture in accordance with aspects of this invention.
Figure 2:
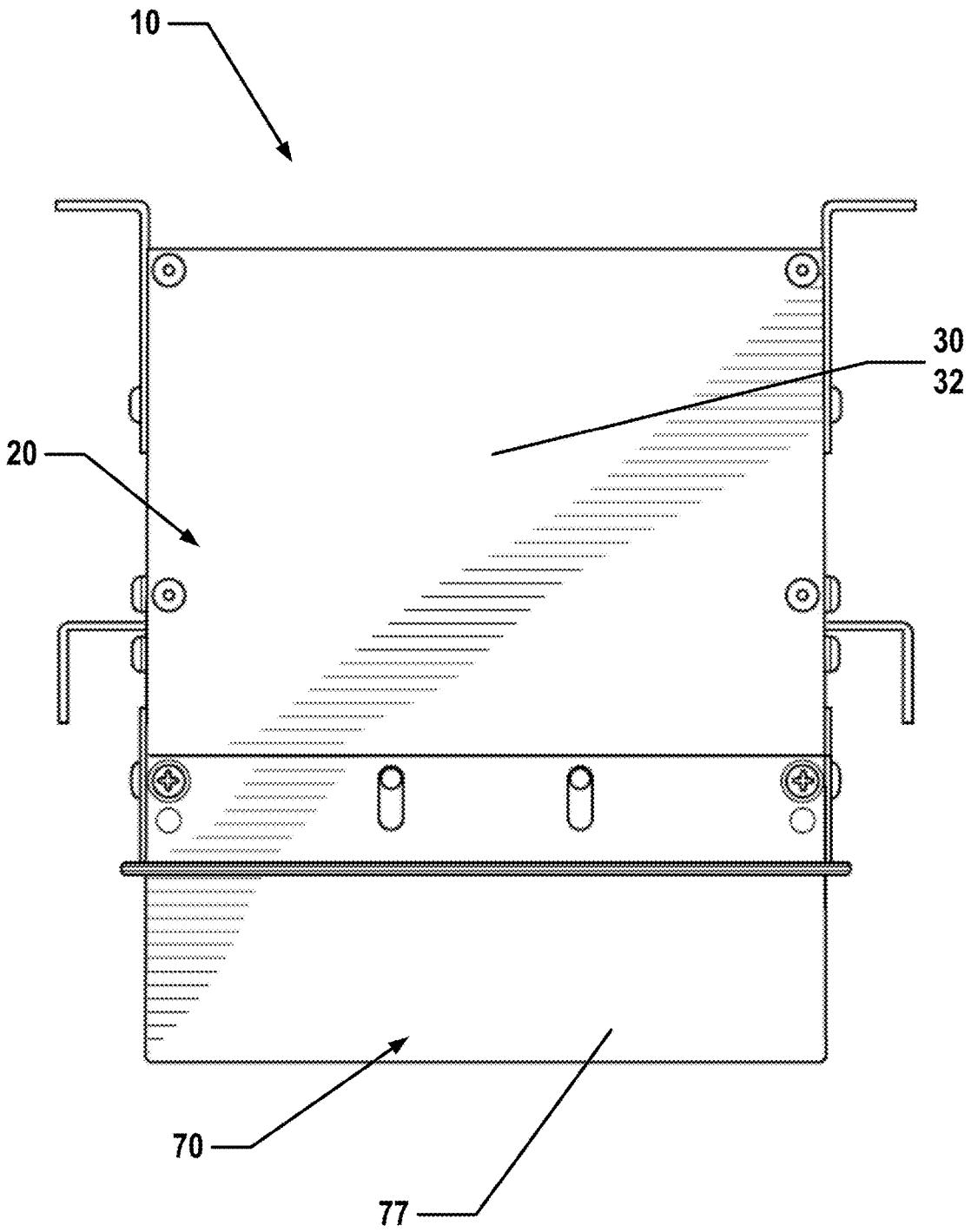
FIG. 2 is an illustration of an end view of the housing and the drop lens of the light fixture of FIG. 1 in accordance with aspects of this invention.
Figure 3:
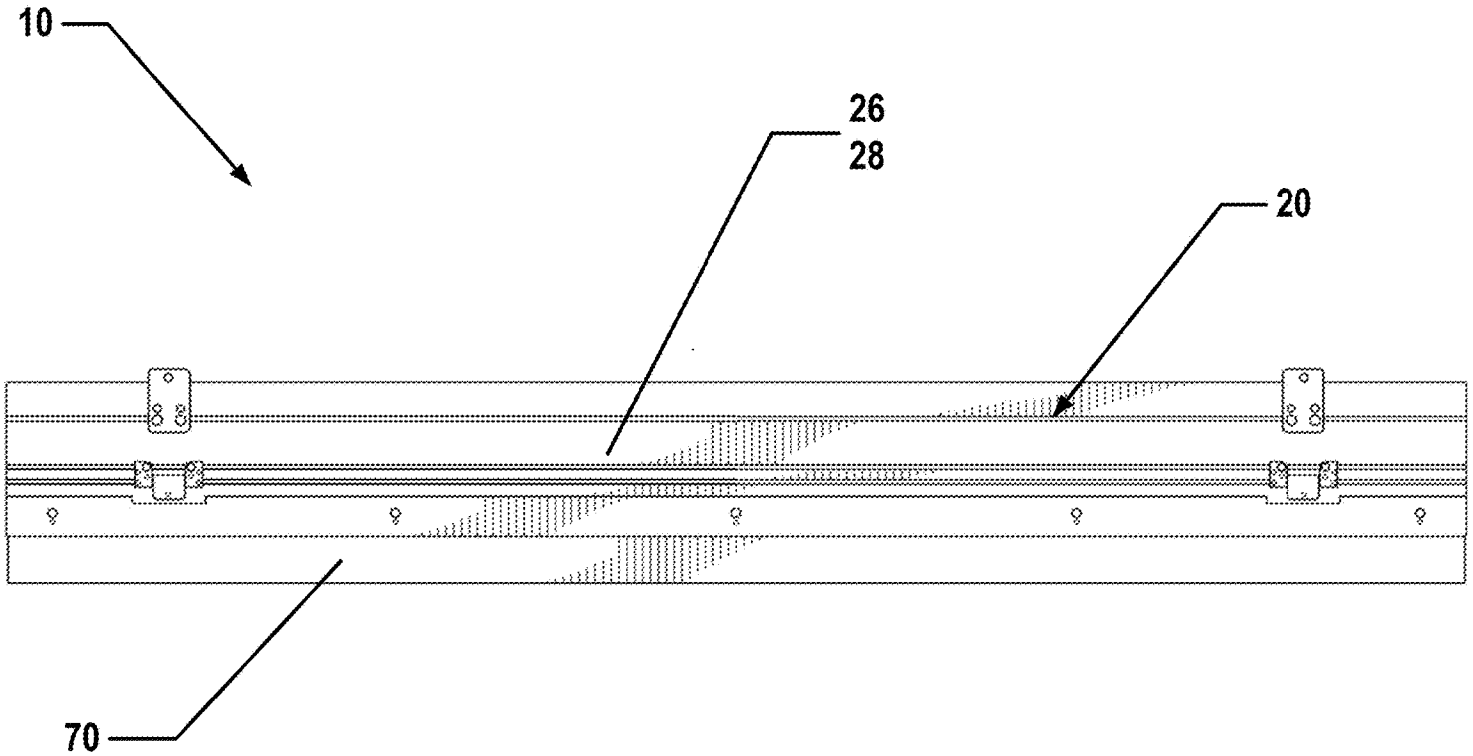
FIG. 3 is an illustration of a side view of the housing and the drop lens of the light fixture of FIG. 1 in accordance with aspects of this invention.

Referring to FIGS. 1-6, a light fixture 10 includes a housing 20, a reflector 50, a light source 100, and a drop lens 70. The drop lens 70 may be attached to the housing 20. As illustrated in FIGS. 1-3, the housing 20 includes a top panel 24, a pair of opposing side panels, 26, 28, and a pair of opposing end panels 30, 32. An inner lens 90 may be located behind the drop lens 70 to eliminate shadows and create a uniform and consistent luminance on the bottom portion 72, side portion 74, 76, and end portion 77 of the drop lens and has provisions for the drop lens to be installed/uninstalled. FIG. 1 is a bottom-angled perspective view of an embodiment of the housing 20 and drop lens 70 of the light fixture 10. FIG. 2 is an illustration of an end view of the housing 20 and the drop lens 70 of the light fixture 10. FIG. 3 is an illustration of a side view of the housing 20 and drop lens 70 of the light fixture 10.

The housing 20 may be generally rectangular in shape. In other embodiments without departing from the invention, the housing 20 may be square or other shapes. The housing 20, which may be made of any desirable material, such as but not limited to aluminum or steel, provides a certain level of protection for the light fixture 10 and the light source 100 and also can protect the surrounding area from heat produced by the light fixture 10. The housing 20 may be an aluminum extrusion in an embodiment of the invention. The top panel 24, side panels 26, 28, and the end panels 30, 32 create a generally rectangular-shaped housing 20. Additionally, the top panel 24 may be attached or formed to the top of each of the side panels 26, 28 and the two end panels 30, 32 to complete the structure of the housing 20.

Figure 4A:
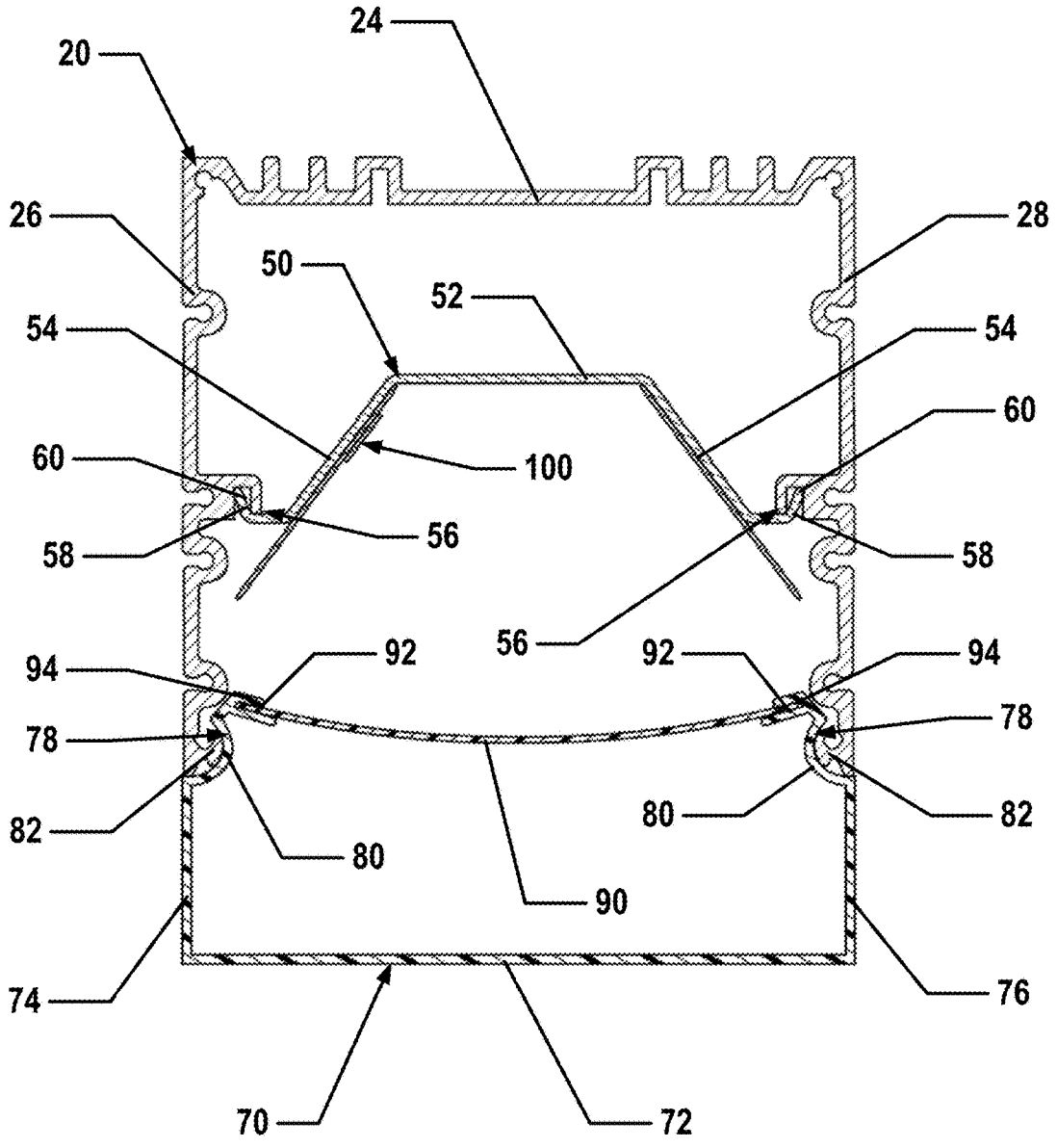
FIG. 4A is an illustration of a top-down cross-sectional view of the housing and the drop lens of the light fixture of FIG. 1 in accordance with aspects of this invention.

Referring to FIGS. 1 and 4A, the invention includes a drop lens 70. The drop lens 70 may act as a diffuser for the light fixture 10. The drop lens 70 may be preferably made of a high-impact frosted acrylic material. The drop lens 70 may also use added color for an opaque appearance. Preferably, the drop lens 70 may be integrally formed as a single, solid but flexible piece of extruded acrylic or plastic. Additionally, the drop lens 70 is preferably constructed of a flexible material so that it can be flexed and bent to engage the housing 20 and the light fixture 10 as described without cracking.

Figure 4B:
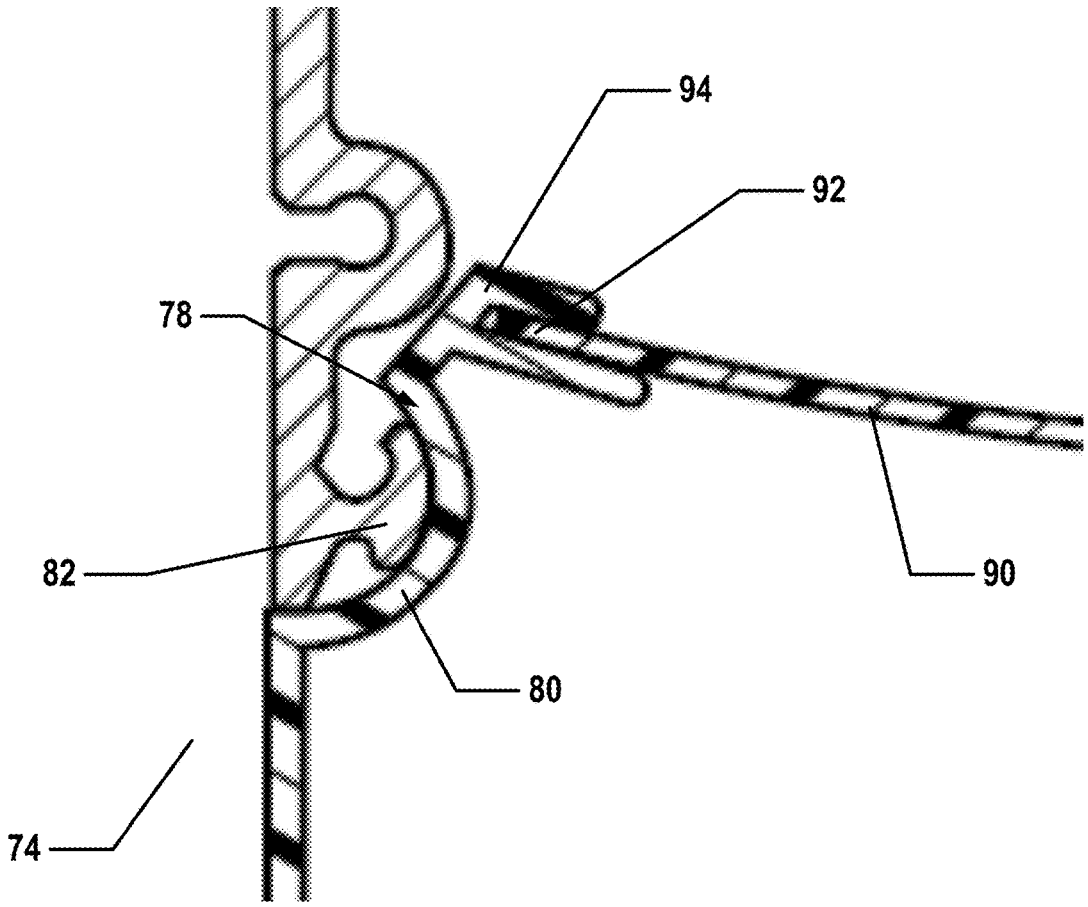
FIG. 4B is an illustration of a close-up view of a top-down cross-sectional view from FIG. 4A of an attaching portion of the housing and the drop lens of the light fixture of FIG. 1 in accordance with aspects of this invention.
Figure 5:
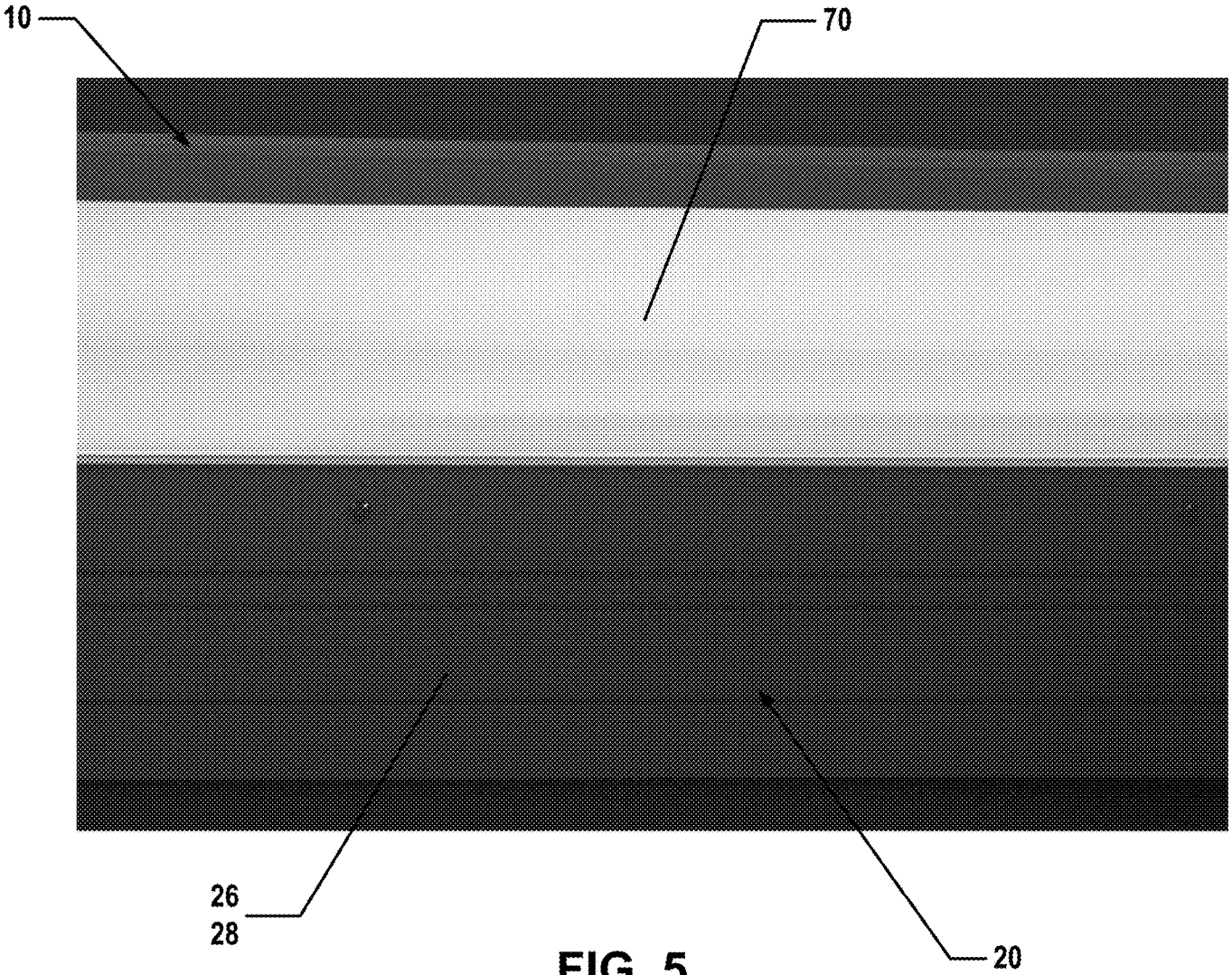
FIG. 5 is a photograph of a side view of a portion of the housing and the drop lens of the light fixture of FIG. 1 in accordance with aspects of this invention.
Figure 6:
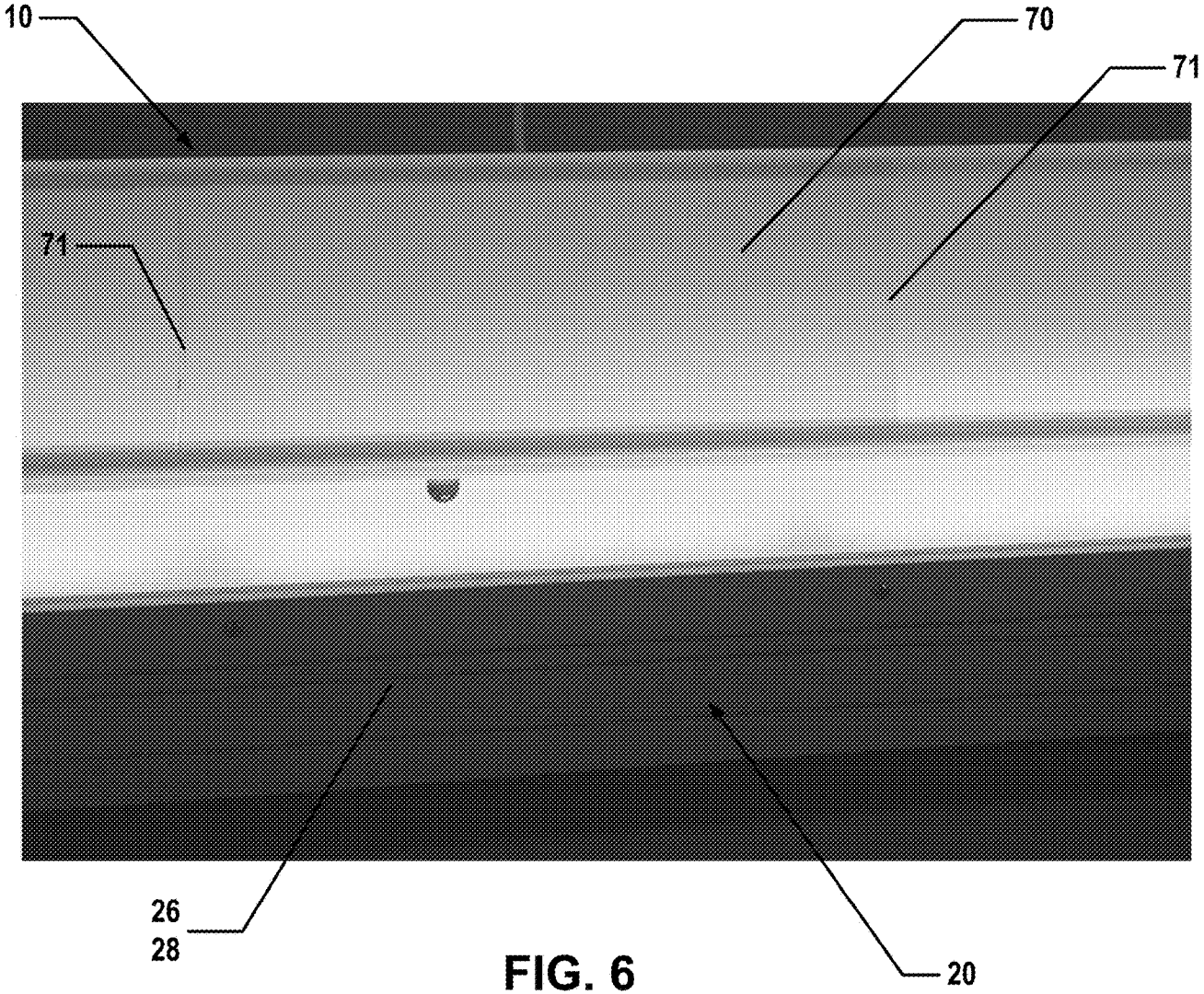
FIG. 6 is another photograph of a side view of a portion of the housing and the drop lens of the light fixture of FIG. 1 in accordance with aspects of this invention.

As shown in FIGS. 1-3, the drop lens 70 may be rectangular and fit over the housing 20. The drop lens 70 may include a bottom portion 72, two side portions 74, 76, and two opposing end portions 77. As illustrated in FIGS. 4A and 4B, the drop lens 70 may include an attaching portion 78 that attaches to and/or engages with the side panels 26, 28 of the housing 20. FIG. 4A illustrates a top-down cross-sectional view of the housing 20 and the drop lens 70 of the light fixture 10, while FIG. 4B illustrates a close-up view of a top-down cross-sectional view of the attaching portion 78 of the drop lens 70 of the light fixture 10. FIGS. 5 and 6 also illustrate how the drop lens 70 attaches to the housing 20 of the light fixture 10, with FIG. 5 illustrating the drop lens 70 attached to the housing 20 and FIG. 6 illustrating the drop lens 70 unattached on one side of the housing 20.

The attaching portion 78 may be located at or near an end of the side portions 74, 76 of the drop lens 70. The attaching portion 78 may include a snap-fit slot 80 that snaps into a snap-fit protrusion 82 that is located on the side panel 26, 28 of the housing 20. The attaching portion 78 may include one snap-fit protrusion 82 or more than one snap-fit protrusion 82 without departing from this invention. Other attaching mechanisms may be utilized without departing from this invention. For example, the drop lens 70 may include a protrusion that snap-fits into a slot located on the side panel 26, 28 of the housing 20. Various other attaching mechanisms known and used in the art may be utilized without departing from this invention.

Other shapes and sizes may be utilized for the drop lens 70 without departing from the invention. For example, the drop lens 70 may include curved surfaces fitting over the housing 20. The drop lens 70 may include multiple linear prisms that extend the full longitudinal direction of the drop lens 70. The linear prisms may diffuse and distribute light from the light source 100 more evenly and thus avoid the appearance of "hot spots," or focused light, emanating from the fixture 10.

As further illustrated in FIGS. 4A and 4B, the drop lens 70 may include an inner lens 90. The inner lens 90 may extend between each of the side portions 74, 76 of the drop lens 70. The inner lens 90 may include two end portions 92 that are located at or near the side portions 74, 76 of the drop lens 70. The end portions 92 may slide or fit into a slot 94 located as part of the side portions 74, 76 of the drop lens 70. The inner lens 90 is preferably constructed of a flexible plastic material so that it can be flexed and bent to engage the side portions 74, 76 of the drop lens 70 as described above.

The inner lens 90 may provide various purposes and advantages. First, the inner lens 90 may disperse the light from the light source 100, thereby eliminating the shadows and creating a uniform and consistent luminance on the bottom portion 72, two side portions 74, 76, and two opposing end portions 77 of the drop lens 70. Additionally, the inner lens 90 creates and forms a structure with the drop lens 70 and greatly enhances the holding forces of the drop lens 70. The inner lens 90 may prevent bugs/debris from behind the visible on the drop lens 70. Additionally, the inner lens 90 may have a plurality of optical performance characteristics to create a desired optical effect on or through the drop lens 70. Furthermore, the inner lens 90 may provide a lateral force to the engagement features of the drop lens 70. Additionally, the inner lens 90 may have a variable thickness and/or material to adjust the lateral force on the drop lens 70.

As shown in FIGS. 1-3, the drop lens 70 may be positioned over the open portion of the housing 20. The drop lens 70 is provided to cover the light source 100. The drop lens 70 may be utilized for a number of other different purposes. The drop lens 70 may be utilized to provide thermal isolation from the light source 100 and the external surroundings to the light fixture 10. The drop lens 70 may also be utilized to meet safety requirements to protect a user from touching or contacting the light source 100. The drop lens 70 may also provide protection to the light source 100 from debris, or dust that could possibly damage the light source 100.

Additionally, the drop lens 70 may include optical lens properties. The drop lens 70 may be a plastic lens. The drop lens 70 may be frosted, clear, prism, or other characteristics depending on the requirements of the light source 100. Additionally, the drop lens 70 may include reflective properties.

As can be appreciated, various known electrical components typically used with a light source 100 and light fixture 10 are required. These components are known in the art and, therefore, further discussion regarding the various electrical components is not required. The housing 20 may additionally include one or more holes suitable for the purpose of either accepting wires and/or for allowing various electrical components to be installed within or connected (either directly or indirectly) to the housing in a known manner. For example, the light source 100 may include LED lights in any configuration as known and used in the art. Additionally, the light source 100 may include T5 high output bulbs configured to provide reflectivity for the high output linear light sources. Additionally, the light source 100 may include T8 bulbs configured to provide reflectivity for the high output linear light sources.

Additionally, the housing 20 may include a reflector 50 as illustrated specifically in FIG. 4A. The reflector 50 may be attached to the side panels 26, 28 of the housing 20. The reflector 50 may be shaped with a flat or horizontal portion 52 and two angled portions 54 which angle downward towards the side panels 26, 28 of the housing 20.

As illustrated in FIG. 4A, the reflector 50 may include an attaching portion 56 that attaches to and/or engages with the side panels 26, 28 of the housing 20. The attaching portion 56 may be located at or near an end of the angled portion 54 of the reflector. The attaching portion 56 may include a snap-fit protrusion 58 that snaps into a slot 60 that is located on the side panel 26, 28 of the housing 20. The attaching portion 56 may include one snap-fit protrusion 58 or more than one snap-fit protrusion 58 without departing from this invention. Other attaching mechanisms may be utilized without departing from this invention. For example, the attaching portion 56 may include a screw that attaches to a mechanical fastener on the side panel 26, 28 of the housing 20. Additionally, the side panel 26, 28 of the housing 20 may include a screw that attaches to a mechanical fastener on the reflector 50. In another example without departing from the invention, the side panel 26, 28 of the housing 20 may include a protrusion that snap-fits into a slot located on the reflector 50. Various other attaching mechanisms known and used in the art may be utilized without departing from this invention.

In another embodiment, the reflector 50 may be integrally formed as part of the side panel 26, 28 of the housing 20. When the reflector 50 is integrally formed as part of the side panel 26, 28 of the housing 20, the angled portion 54 may extend from the side panel 26, 28.

Figure 7:
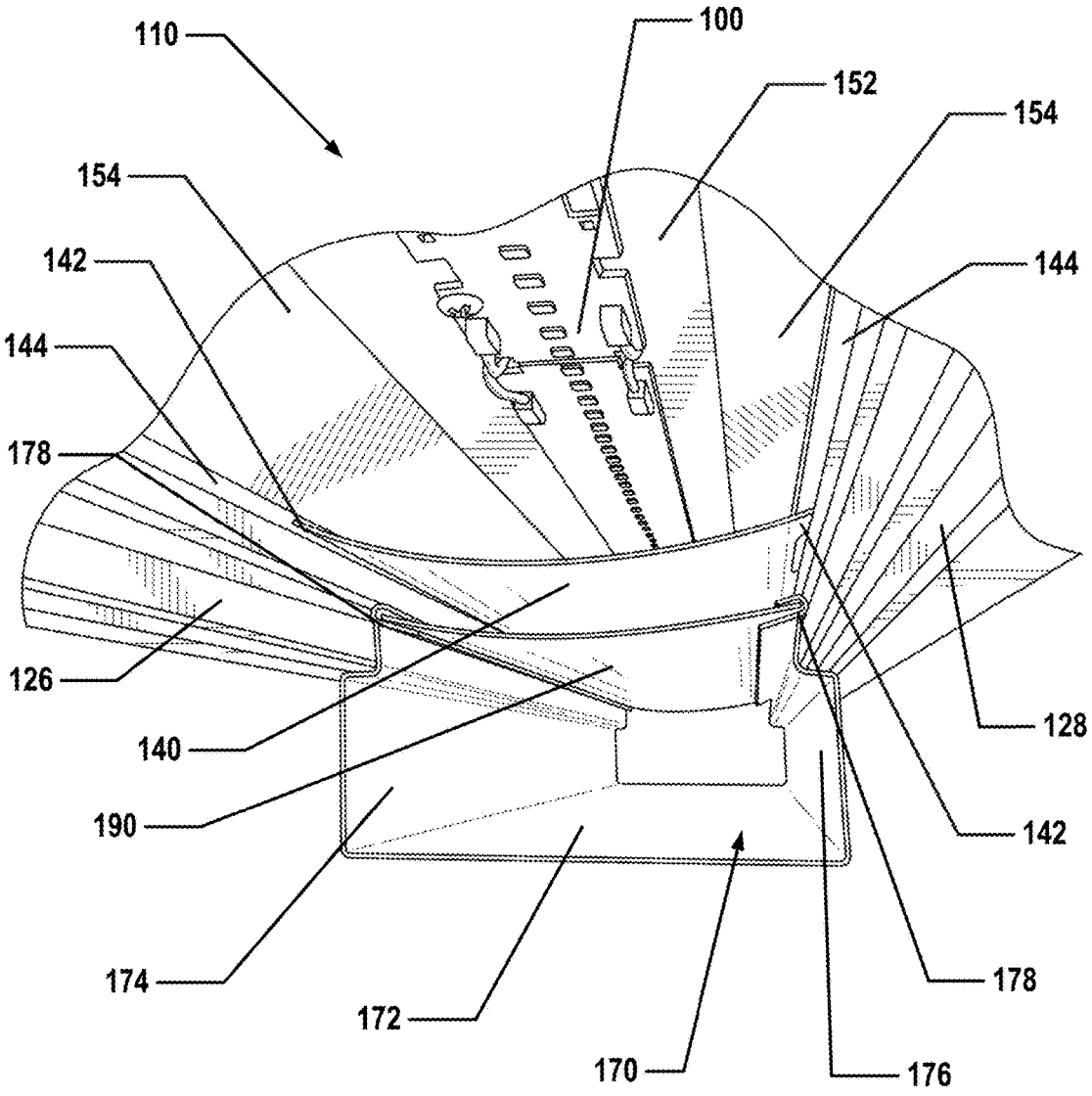
FIG. 7 is an illustration of a side perspective view of another embodiment of a housing and a drop lens of a light fixture in accordance with aspects of this invention.
Figure 8:
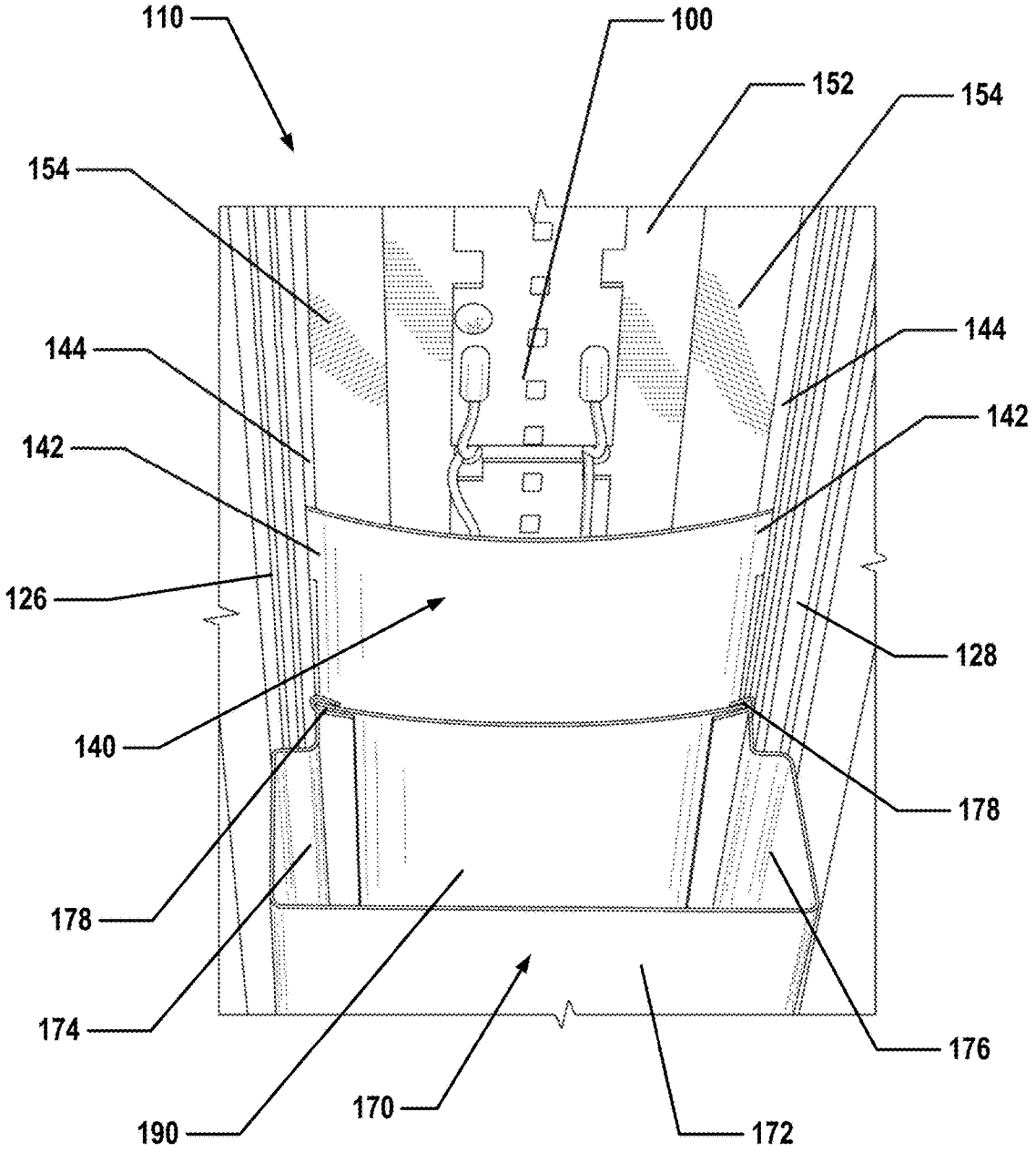
FIG. 8 is an illustration of a top-angled perspective view of the housing and the drop lens of the light fixture of FIG. 7 in accordance with aspects of this invention.
Figure 9:
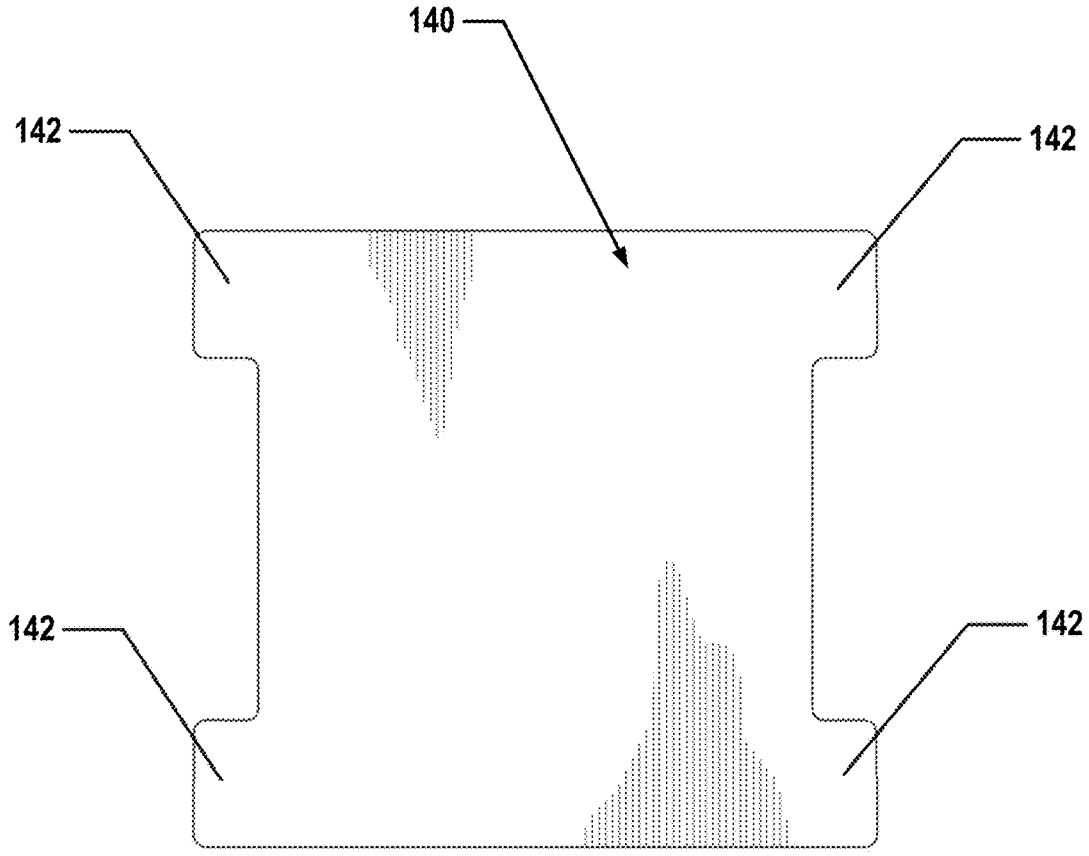
FIG. 9 is an illustration of an upper lens utilized in the housing and the drop lens of the light fixture of FIG. 7 in accordance with aspects of this invention.

FIGS. 7-9 illustrate an alternate embodiment of the light fixture 10 that may be part of a light fixture assembly. The light fixture 110 illustrated in FIGS. 7-9 may be configured to be assembled or connected together for multiple light fixtures and/or multiple drop lens sections are used. FIGS. 7-9 show the light fixture 110 with a drop lens 170, a first inner lens 190, and a second inner lens 140. The second inner lens 140 may be slidably engaged with the housing 120 or the drop lens 170 to hide the view to a light source 100 through potential gaps or seams 71 between sections of the drop lens 170 when multiple light fixtures and multiple drop lens sections are used (the seam can be seen in FIG. 6 and labeled as reference number 71). The second inner lens 140 may cover the gap or seam 71 between adjacent drop lens sections 170 of light fixtures joined together because the second inner lens 140 can slide within the housing and drop lens to be offset with the gap or seam 71. For the embodiment of FIGS. 7-9, the features are referred to using similar reference numerals under the "1xx" series of reference numerals, rather than "xx" as used in the embodiment of FIGS. 1-6. Accordingly, certain features of the light fixture 110 that were already described above with respect to the light fixture 10 of FIGS. 1-6 may be described in lesser detail, or may not be described at all. Additionally, the features of the light fixture 10 of FIGS. 1-6 may also be included with the light fixture 110 of FIGS. 7-9.

FIGS. 7-9 illustrate a light fixture 110 that includes a housing 120, a reflector 150, a light source 100, and a drop lens 170. The drop lens 170 may be attached to the housing 120 as described above and illustrated in FIGS. 1-3. As illustrated in FIGS. 7 and 8, the housing 120 includes a pair of opposing side panels, 126, 128.

Referring to FIGS. 7 and 8, the invention includes a drop lens 170 or drop lens sections. The drop lens 170 may act as a diffuser for the light fixture 110. The drop lens 170 may be preferably made of a high-impact frosted acrylic material. The drop lens 170 may also use added color for an opaque appearance. Preferably, the drop lens 170 may be integrally formed as a single, solid but flexible piece of extruded acrylic or plastic. Additionally, the drop lens 170 is preferably constructed of a flexible material so that it can be flexed and bent to engage the housing 120 and the light fixture 110 as described without cracking. As stated above, when multiple light fixtures are used, there may be drop lens sections as part of the drop lens 170 with a potential gap between the drop lens sections.

As shown in FIGS. 7 and 8, the drop lens 170 may be rectangular and fit over the housing 120. The drop lens 170 may include a bottom portion 172, two side portions 174, 176, and two opposing end portions 77 (end portions 77 are illustrated in FIG. 2). However, when multiple light fixtures 110 and multiple drop lens sections 170 are joined together, only the outermost drop lens sections 170 have end portions 77 and the inner drop lens sections 170 will have no end portions 77. As illustrated in FIGS. 7 and 8, the drop lens 170 may include an attaching portion 178 that attaches to and/or engages with each of the side panels 126, 128 of the housing 120.

The attaching portion 178 may be located at or near an end of the side portions 174, 176 of the drop lens 170. The attaching portion 178 may include a snap-fit connection that snaps into each of the side panels 126, 128 of the housing 120. The attaching portion 178 may include one or more snap-fit connections without departing from this invention. Other attaching mechanisms for the attaching portion 178 and side panels 126, 128 of the housing 120 may be utilized without departing from this invention.

Other shapes and sizes may be utilized for the drop lens 170 without departing from the invention. For example, the drop lens 170 may include curved surfaces fitting over the housing 120. The drop lens 170 may include multiple linear prisms that extend the full longitudinal direction of the drop lens 170. The linear prisms may diffuse and distribute light from the light source 100 more evenly and thus avoid the appearance of "hot spots," or focused light, emanating from the fixture 110.

As further illustrated in FIGS. 7 and 8, the drop lens 170 may include a first inner lens 190. The first inner lens 190 may extend between each of the side portions 174, 176 of the drop lens 170. The first inner lens 190 may slide or fit into the side portions 174, 176 of the drop lens 170. The first inner lens 190 is preferably constructed of a flexible plastic material so that it can be flexed and bent to engage the side portions 174, 176 of the lens as described above.

In addition to the first inner lens 190, the light fixture 110 may include a second inner lens 140. The second inner lens 140 may extend between each of the side panels 126, 128 of the housings 120 that are connected together. As specifically illustrated in FIG. 9, the second inner lens 140 may include a set of tabs 142. The set of tabs 142 may be configured to slide or fit into a slot 144 located as part of the side panels 126, 128 of the housings 120 that are connected together. As illustrated in FIG. 9, the set of tabs 142 may include four tabs in each of the corners of the second inner lens 140. The set of tabs 142 may include more or less tabs as required in order to hold the second inner lens 140 the side panels 126, 128 of the housings 120 that are connected together. The second inner lens 140 is preferably constructed of a flexible plastic material so that it can be flexed and bent to engage the side panels 126, 128 of the housing 120 as described above.

Additionally, the second inner lens 140 may be slidably engaged with the housings 120 that are connected together and slide within the drop lens 170 sections to hide the view of the light source 100 through potential gaps or seams 71 between sections of the drop lens 170. For example, when connecting multiple fixtures, drop lens sections 170 may be located adjacent to each other thereby creating a gap or seam 71 between the drop lens sections 170. The second inner lens 140 may be located between and slidably engaged with each of the side panels 126, 128 of the housings 120 that are connected together and beyond the gap seam 71 or end of the drop lens sections 170 and/or the first inner lens 190. The second inner lens 140 may slide and protrude into an adjacent fixture 110 to cover the gap or seam between adjacent drop lens sections 170 because the second inner lens 140 is offset. FIGS. 7 and 8 illustrate the second inner lens 140 extending beyond the end of the drop lens section 170 and beyond the gap or seam 71 to thus cover the gap or seam 71 between adjacent drop lens sections 170.

The present invention has been described in terms of preferred and exemplary embodiments thereof. Numerous other embodiments, modifications and variations within the scope and spirit of the appended claims will occur to persons of ordinary skill in the art from a review of this disclosure.

What is claimed is:

1. A light fixture assembly comprising:

one or more light fixtures joined together and adjacent to each other, the one or more light fixtures each including:

a housing that includes a top panel, a pair of opposing side panels, and a pair of opposing end panels on each of two outermost housings;

a light source attached to the housing;

a drop lens section with a bottom portion, two side portions, and two opposing end portions on each of two outermost drop lens sections, the drop lens section attached to the side panels of the housing, the drop lens section further including a first inner lens that extends between each of the side portions of the drop lens section, the first inner lens disperses light from the light source, thereby creating a uniform and consistent luminance on the bottom portion, the two side portions, and the two opposing end portions of the drop lens section; and a second inner lens rectangular in shape, the second inner lens extends between and is slidably engaged with each of the side panels of adjacent housings, wherein the second inner lens slides within the adjacent housings to hide the light source through a gap between the drop lens sections.

2. The light fixture of claim 1, wherein the one or more light fixtures is repeated to a plurality of housings, light sources, and drop lenses to enable configurable lengths.

3. The light fixture of claim 1, wherein the second inner lens slides within and is engaged by the adjacent housings.

4. The light fixture of claim 1, wherein the second inner lens slides within and is engaged with the side panels of the housing.

5. The light fixture of claim 1, wherein the second inner lens is constructed of a flexible plastic material so that the second inner lens can be flexed and bent to engage the side panels of the housing.

6. The light fixture of claim 1, wherein the drop lens is constructed of a flexible material so that the drop lens can be flexed and bent to engage the housing.

7. The light fixture of claim 1, wherein the first inner lens and the second inner lens have a plurality of optical performance characteristics to create a desired effect on the drop lens.

8. The light fixture of claim 1, wherein the first inner lens is constructed of a flexible plastic material so that the first inner lens can be flexed and bent to engage the side portions of the drop lens.

9. The light fixture of claim 1, wherein the first inner lens prevents bugs and debris from being visible on the drop lens.

* * * * *